US006127982A

United States Patent [19]

Terk

[11] Patent Number: 6,127,982

[45] Date of Patent: Oct. 3, 2000

[54] APPARATUS AND METHOD FOR PROCESSING SATELLITE AND TERRESTRIAL SIGNALS

[75] Inventor: Neil D. Terk, Laurel Hollow, N.Y.

[73] Assignee: Terk Technologies Corp., Commack, N.Y.

[21] Appl. No.: 09/220,287

[22] Filed: Dec. 23, 1998

[51] Int. Cl.[7] ..... H01Q 21/00

[52] U.S. Cl. ..... 343/725; 343/727; 343/840; 343/879

[58] Field of Search ..... 343/725, 795, 343/840, 879, 727; H01Q 21/00

[56] References Cited

U.S. PATENT DOCUMENTS

| | | | |
|---|---|---|---|
| 5,604,508 | 2/1997 | Atkinson | 343/725 |
| 5,606,334 | 2/1997 | Amarillas et al. | 343/840 |
| 5,793,336 | 8/1998 | Shoemaker et al. | 343/795 |
| 5,929,818 | 7/1999 | Snyder | 343/725 |
| 5,933,123 | 8/1999 | Kaul | 343/725 |
| 5,999,137 | 12/1999 | Crosby | 343/725 |

*Primary Examiner*—Don Wong
*Assistant Examiner*—Hoang Nguyen
*Attorney, Agent, or Firm*—Hoffman & Baron, LLP

[57] ABSTRACT

An antenna assembly is disclosed that comprises a terrestrial antenna and a support that mounts the antenna assembly on a satellite dish antenna. The satellite dish antenna has a convex/concave configuration, a periphery, a front signal receiving surface. The terrestrial antenna comprises a pair of dipoles. A power amplifier has an input connected to the terrestrial antenna to receive and amplify its terrestrial video signal. A diplexer is further provided and has first and second input terminals and an output terminal. The second input terminal is connected to the power amplifier to receive the amplified terrestrial video signal. The first input terminal is adapted to be connected to the satellite dish to receive the satellite video signal. The diplexer operates to sum the amplified terrestrial signal and the satellite video signal to provide an aggregate signal to the output terminal.

6 Claims, 7 Drawing Sheets

APPARATUS AND METHOD FOR PROCESSING SATELLITE AND TERRESTRIAL SIGNALS

FIELD OF THE INVENTION

This invention relates to the ready assembly of satellite dish type antennas and UHF/VHF antennas either as an after market or direct marketed product.

BACKGROUND OF THE INVENTION

Satellite dish antennas have gained popularity, in part, for their capability to provide TV programming from a number of program sources greater than that available from the local, terrestrial VHF and UHF stations. However, such dish antennas are adapted to receive video signals from satellites disposed in synchronous or stationary orbits about the earth to the exclusion of the locally transmitted VHF and UHF signals. To enable reception of locally transmitted video signals and the locally produced TV programs, it is necessary to also employ antennae that are adapted to receive signals in the VHF and UHF ranges.

U.S. Pat. No. 5,793,336 of Amarilllas et al. relates to a combination of a compact, rectangularly shaped assembly of a reflector or dish with fragmented curved surfaces and a VHF/UHF antenna, which is mounted on the reflector. Further, an amplifier processes the signals from the reflector and its waveguide. The antenna is mounted on the periphery of the reflector and its cover.

U.S. Pat. No. 5,793,336 of Shoemaker et al. discloses the combination of two antennas, the first comprises a nonconductive layer on which is deposited first and second radiators, and the second is in the form of a double curved dish. The first antenna is disposed in a housing, which includes a back plate. The plate conforms to the shape of the back of the double curved dish against which it is mounted.

None of the patents discussed above deal with the needs or problems presented by the aftermarket, where it often desired to add UHF/VHF reception capability to an installed satellite dish antenna. Of course, a second UHF/VHF antenna could be installed at the expense of the esthetic appearance of the structure, e.g., a residence, to which two antennae are mounted. The resultant assembly of dish and UHF/VHF antennas must, of course, function when so assembled to receive their respective spectrums of the wireless video signal transmissions.

In a copending patent application Ser. No. 08/856,388, entitled "COMBINATION SATELLITE DISH WITH UHF/VHF ANTENNA" and filed May 15, 1997 in the name of Donald L. Snyder, there is disclosed an assembly comprising in its four figures a dish antenna and a UHF/VHF antenna, which includes two dipoles or portions. These portions are bent into a configuration similar to that of the dish. The UHF/VHF antenna is secured to the dish by supports.

The TV signals from the satellite source and the terrestrial source are outputted from the satellite dish antenna and the UHF/VHF antenna respectively and may be transmitted by coax cable in a variety of ways to the satellite receiver that is disposed within a building or home, on which this antenna assembly is mounted. As is well known in the art, the satellite receiver performs a number of functions. First, the receiver receives and demodulates the TV signals before feeding them to the TV display or set for viewing. Second, the satellite receiver also provides a selective switching function, whereby the viewer may select which of the satellite and the terrestrial signals is to be viewed and to apply that selected signal to the TV set. In one mode, two coax cables are run between the satellite receiver and the antenna assembly.

In a second mode, a pair of diplexers is used to permit but a single coax cable to be used to bring both of the satellite and terrestrial signals to the satellite receiver. In this mode, the cable from the UHF/VHF antenna is coupled to the VHF/UHF terminal of the diplexer, whereas the cable from the satellite dish antenna is coupled to the SAT terminal on the diplexer. The first diplexer is connected to the building structure, typically by a fastener such as a pair of screws.

Further, suitable amplifiers are available to improve fringe area reception of the VHF/UHF TV transmission by amplifying this signal. It is appreciated that the satellite receiver is designed to provide sufficient amplification to the satellite TV signal without the use of an additional amplifier. Where two coaxial cables are used to transmit the terrestrial and satellite signals to the satellite receiver, the UHF/VHF amplifier is inserted in circuit with the UHF/VHF cable, typically in proximity to the satellite signal. Where only a single cable is used to carry the terrestrial and satellite signals and two diplexers are used as described above, the UHF/VHF amplifier is connected in circuit between the second diplexer that is disposed within the structure, and the satellite receiver. The installation of the diplexers and/or UHF/VHF amplifier is complicated by the use of two cables or, in the alternative, the incorporation of two diplexers. It would be desirable, as taught by this invention, to simplify the interconnection of the antenna assembly and the satellite receiver disposed in the structure by using only one cable to carry these signals into the structure, and to eliminate the need to mount and to connect a separate UHF/VHF antenna.

However, in view of the art considered as a whole at the time the present invention was made, it was not obvious to those of ordinary skill in this art how the needed improvements could be provided.

SUMMARY OF THE INVENTION

It is therefore an object of this invention to provide a new and improved antenna subassembly adapted to be mounted readily on a satellite dish antenna and to be connected to its satellite receiver.

It is a still further object of this invention to provide a new and improved antenna assembly that permits its installation and connection to its receiver by a minimum number of cables and without the need to further mount various electrical devices associated with the subassembly and/or the satellite dish antenna.

These and other important objects, features, and advantages of the invention will become apparent as this description proceeds. This invention involves an antenna assembly which comprises a mounting base adapted to be secured to a structure, a satellite dish antenna and a terrestrial antenna. The satellite dish antenna has a convex/concave configuration, a periphery, a front signal receiving surface and a rear surface. The rear surface is secured to a support base. The terrestrial antenna comprises a pair of dipoles. A support mounts the antenna assembly and comprises a pair of sleeves for readily receiving and supporting the pair of dipoles of the antenna assembly respectively in a substantially parallel relationship to each other, and a member which readily supports the terrestrial antenna to a variety of satellite dish antennas of different sizes and configurations.

In a further aspect of this invention, a UHF/VHF antenna subassembly is adapted to be coupled to a satellite dish antenna to form an antenna subassembly therewith. The subassembly comprises a terrestrial antenna, a power amplifier and a diplexer. The terrestrial antenna includes a pair of dipoles for receiving and outputting a terrestrial video signal. The power amplifier has an input connected to the terrestrial antenna to receive and amplify the terrestrial video signal. The diplexer has first and second input terminals and an output terminal. The second terminal is connected to the power amplifier to receive the amplified terrestrial video signal. The first terminal is adapted to be connected to the satellite dish to receive the satellite video signal. The diplexer is operative to sum the amplified terrestrial signal and the satellite video signals to transmit in a first direction an aggregate signal to its output terminal.

In a further embodiment of this aspect, the output terminal of the diplexer receives a power signal and is operative to transmit in a second direction opposite to said first direction the power signal via the first input to the power amplifier, whereby the power amplifier is energized.

In a still further aspect of this invention the satellite dish antenna is adapted to include first and second receivers for outputting respectively first and second satellite video signals and there is further included a second diplexer. The second diplexer includes third and fourth input terminals and a second output terminal. The first and third input terminals are adapted to be connected to the first and second receivers to receive respectively the first and second satellite video signals. The power amplifier is connected to each of the second and fourth input terminals to apply thereto the amplified terrestrial video signal. Thus, the first mentioned and the second diplexers transmits in a first directions to their first mentioned and said second output terminals first and second aggregate signals respectively to be outputted therefrom. At least one of the first mentioned and the second output terminals receives a power signal and is operative to transmit in a second direction opposite to the first direction the power signal via the second and fourth input terminals the power signal to the power amplifier, whereby the power amplifier is energized.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DESCRIPTION OF THE PREFERRED EMBODIMENT OF THIS INVENTION

Figure 1A:
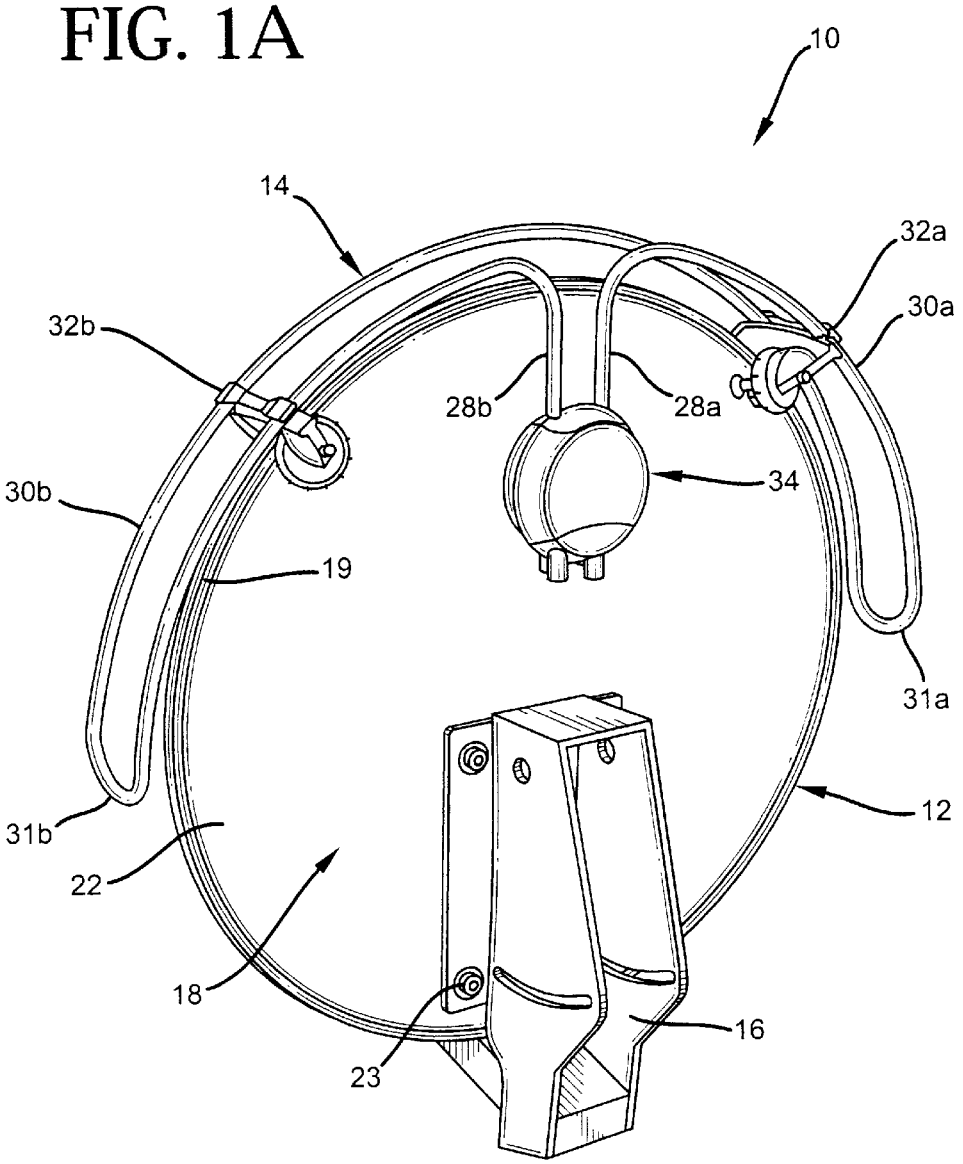
FIGS. 1A and B are respectively front and rear perspective views of an antenna assembly that includes a video satellite dish antenna and a UHF/VHF antenna and a device for readily mounting the UHF/VHF antenna to the dish antenna in accordance with the teachings of this invention.

Referring now to the drawings and in particular to FIGS. 1A and B, there is shown an antenna assembly represented generally by numeral 10 that comprises a dish shaped satellite antenna identified by the numeral 12 for receiving TV or video signals transmitted from satellites that are placed in a stationary or asynchronous orbit about the earth, a UHF/VHF antenna identified by the numeral 14 for receiving video signals of such bandwidths from a local, terrestrially based transmitter of such signals, and at least one support identified by the numeral 32 for mounting the UHF/VHF antenna 14 in the assembly 10 with respect to the satellite dish antenna 12.

Figure 1B:
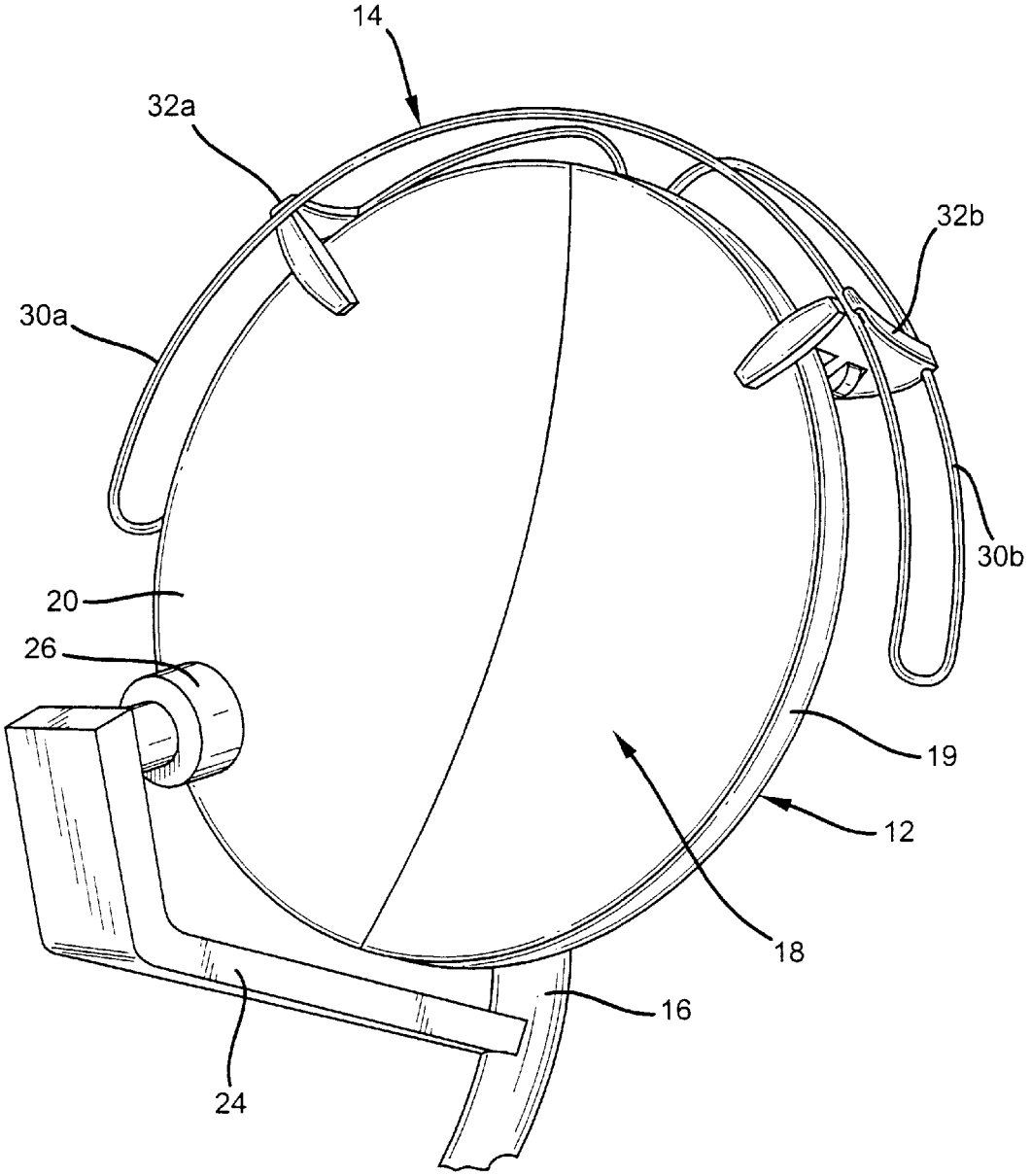

Still referring to FIGS. 1A and B, the antenna assembly 10 and, in particular, the satellite dish antenna 12 is supported upon a base 16, which is in turn adapted to be fixedly secured to a structure, e.g., a residence, where the TV receiver is placed. Typically, the antenna assembly 10 is mounted to permit a line of sight orientation between the dish antenna 12 and the satellite from which the video signals are transmitted. The satellite dish antenna 12 comprises a shell 18 which is of concave/convex configuration that is well know in the art. As illustrated in FIG. 1, the shell 18 has a periphery 19 which is of a substantially circular configuration. The dish antenna 12 has a front, signal receiving side 20 as shown in FIG. 1B and a rear side 22 as shown in FIG. 1A. The support base 16 is affixed to the rear side 22 by suitable fasteners such as the nuts and bolts collectively identified by the numeral 23.

As shown in FIG. 1B, a support arm 24 is affixed to the support base 16 to extend upwardly from the base 16 and forwardly of the front side 20 to support at least one sensor 26 at a focal point of the signals reflected from the front signal receiving side 22 of the concave/convex shaped shell 18. In a first embodiment of this invention that will be more fully described below with respect to FIG. 3A, a single sensor 26 is provided to receive and output a single satellite video signal, which is transmitted to a receiver for display upon a TV set. In a second embodiment that will be described below with respect to FIG. 3B, first and second sensors 26*a* and *b* are mounted at the distal end of the support arm 24, whereby two satellite video signals may be transmitted by cable into the structure and viewed on two TV sets.

Still referring to FIGS. 1A and B, the UHF/VHF antenna 14 includes a pair of dipoles 28*a* and *b*, each of which extends upwardly from a housing 34 in a substantially vertical direction, before being bent away from each other in opposite directions to form a pair of u-shaped arms 30*a* and *b*. Each of the arms 30*a* and *b* extends away from its dipole 28*a* or *b*, respectively. At the remote ends, each arm 30 is bent in a U-shaped byte 31 before extending back towards each other and being connected to the other arm. The first and second arms 30*a* and *b* are configured to follow the circular periphery 19 of the dish antenna 12. As shown in FIGS. 1A and B, the spacing between the first and second arms 30*a* and *b* and the periphery is kept substantially equal.

At least one support 32 is interposed between the dish antenna 12 and the UHF/VHF antenna 14 to wholly support the UHF/VHF antenna 14 upon the satellite dish antenna 12. As described above, the dish antenna 12 is mounted from a structure by the support base 16. In this manner, this illustrated embodiment of this antenna assembly eliminates the need for a second base to support two UHF/VHF antennas from the structure.

Further, the support 32 permits the mounting of the UHF/VHF antenna 14 to satellite dish antennas of varying dimensions and configurations. In the claims that follow, the term a "variably mounting" support shall be interpreted as including a support that may be so mounted to a variety of satellite dish antennas of varying size and configuration. For example, the support for the Sat-T Trol Satellite Dish is not "variably mounting" in that its support is particularly adapted to mount satellite dish antennas of a particular configuration, namely a satellite dish with a cylindrically-shaped lip. In the following, a number of embodiments of the support 32 will be described that are deemed to be "variably mounting". The "variably mounting" support of this invention as so described is adapted to be mounted not only on the Sat-Trol Satellite antenna, but also those satellite dish antennas as manufactured by Sony and RCA.

Figure 2A:
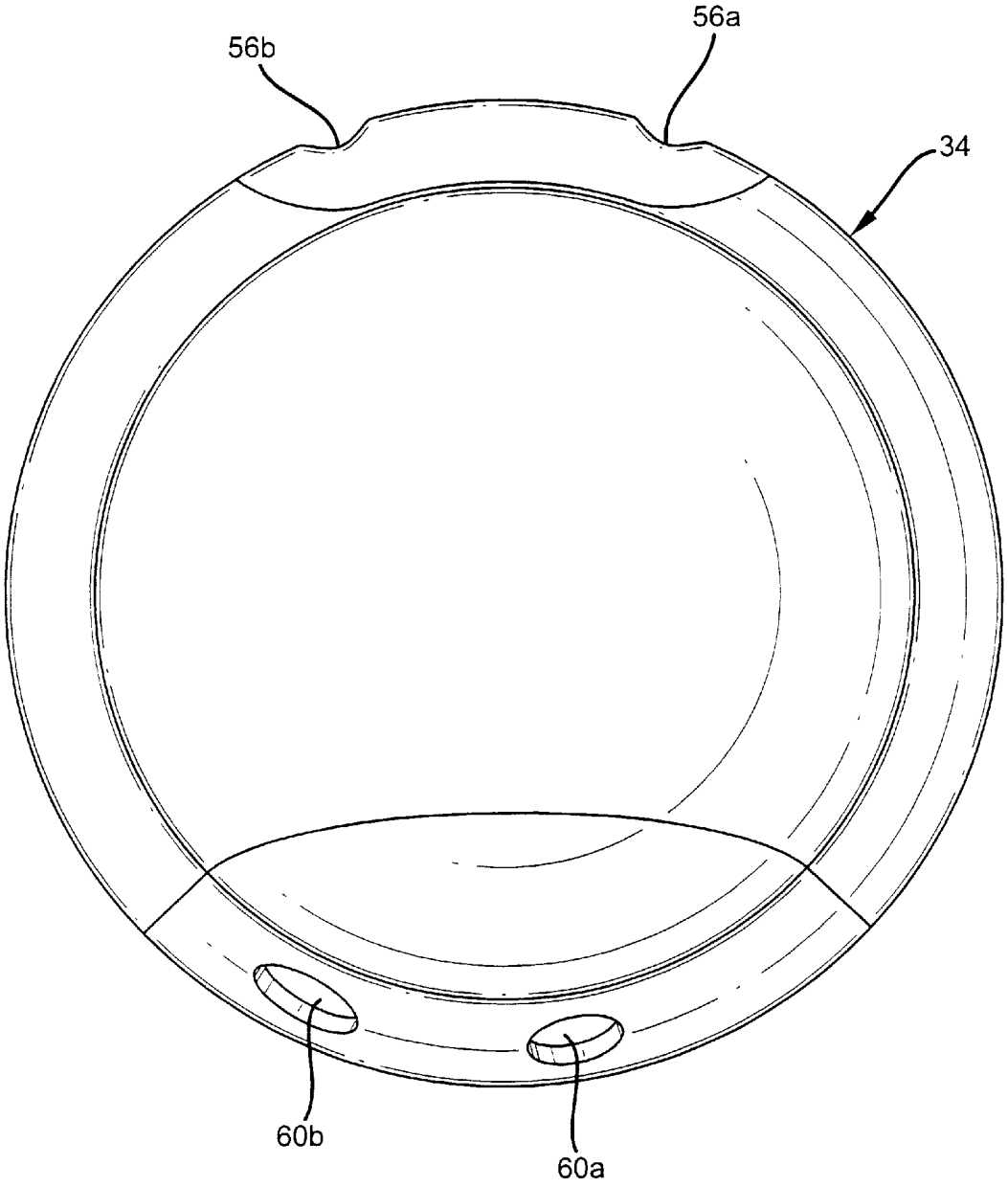
FIGS. 2A, B and C are respectively a top plan view of a housing for a processor circuit for receiving the signals from each of the antennas and combining them into a unitary signal to be fed to a suitable TV receiver, a further plan view of the processor housing sectioned along line B—B of FIG. 2A, and a side view of the processor housing sectioned along line C—C of FIG. 2B.
Figure 2B:
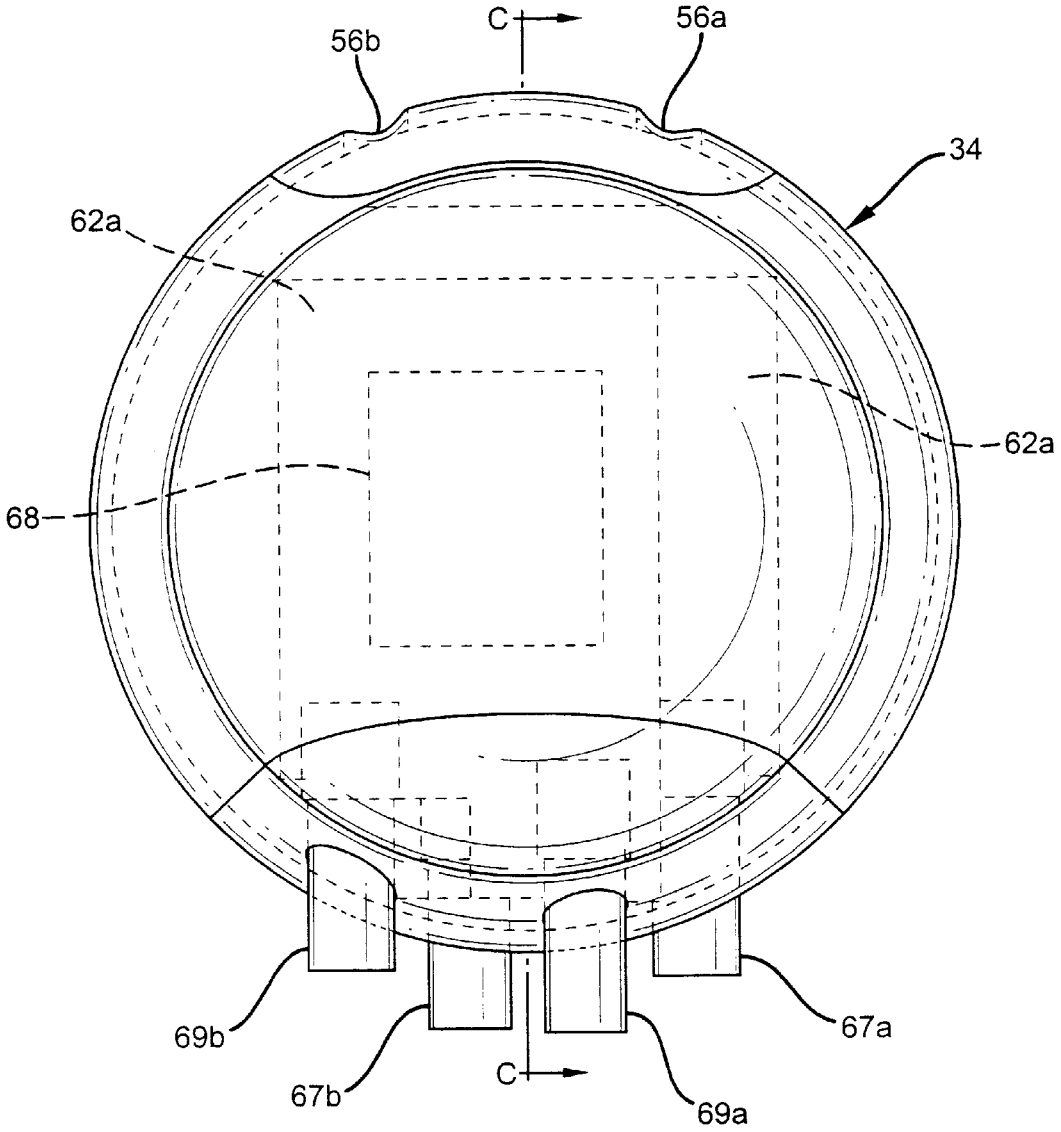
Figure 2C:
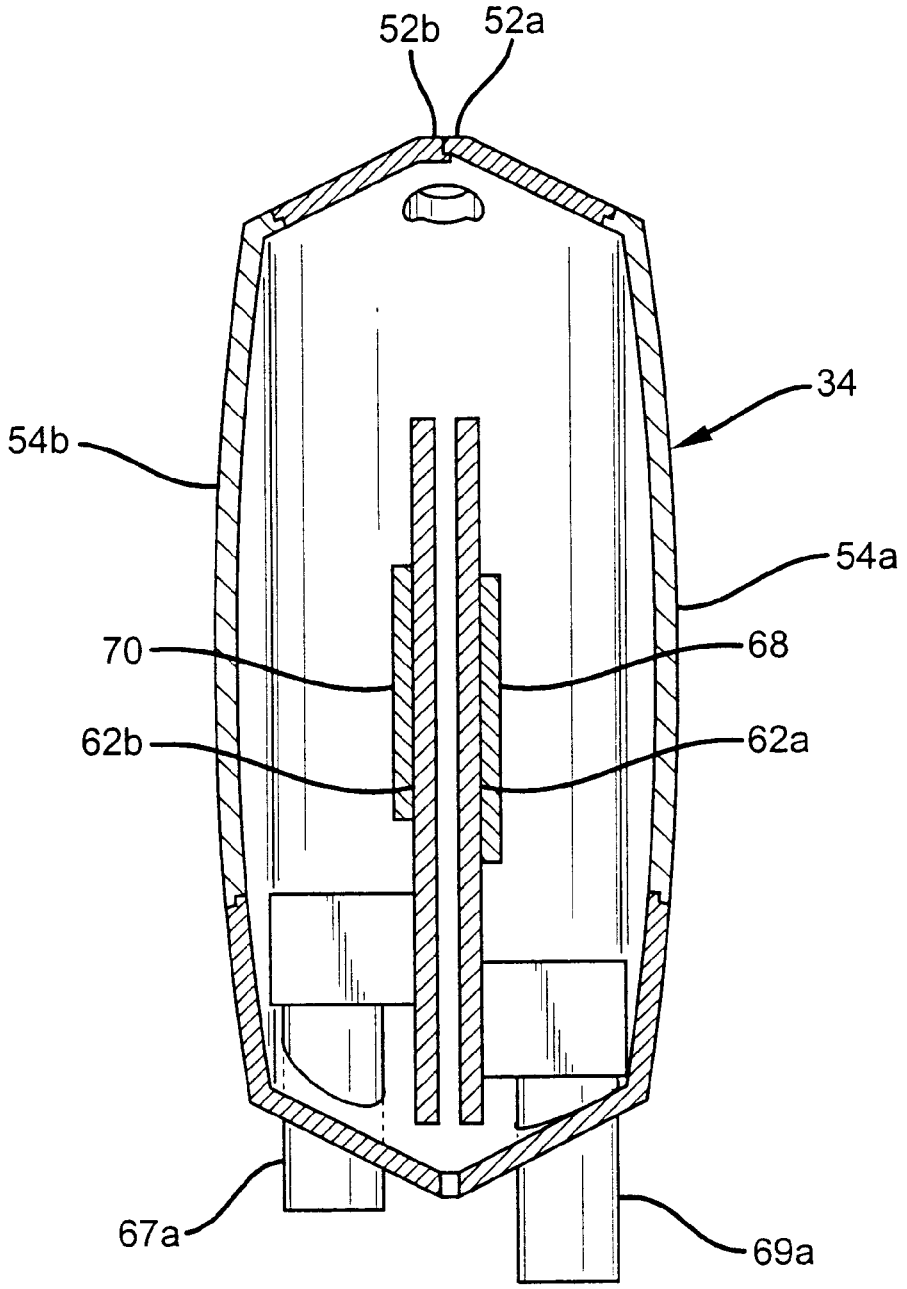

Referring now to FIGS. 2A, B and C, there is shown the housing 34 for receiving diplexor circuitry 70 and amplifying circuitry 68 that receives the TV signals respectively from the UHF/VHF antenna 14 and the satellite dish antenna 12 and sums them together to provide a composite signal to the TV receiver. The housing 34, as best shown in FIG. 2C, comprises first and second sections 54*a* and *b*, which are configured to mate with each other at their opening edges 52*a* and *b*. On the upper part of the housing 34, as shown in FIG. 1A, there are disposed two openings 56*a* and *b* for respectively receiving the first and second dipoles 28*a* and *b*. A pair of circuit boards 62*a* and *b* are mounted to the housing by means well known in the art. As best shown in FIGS. 2B and C, input of the diplexer circuitry 70 on board 62*b* are connected to a pair of terminals 69*a* and *b*, while outputs of the diplexer circuitry 70 on board 62*b* are connected to a pair of terminals 69*a* and *b*. Each of the input terminals 67*a* and *b* is a coaxial terminal, which is connectable via a coaxial cable to the sensor 26.

Figure 3A:
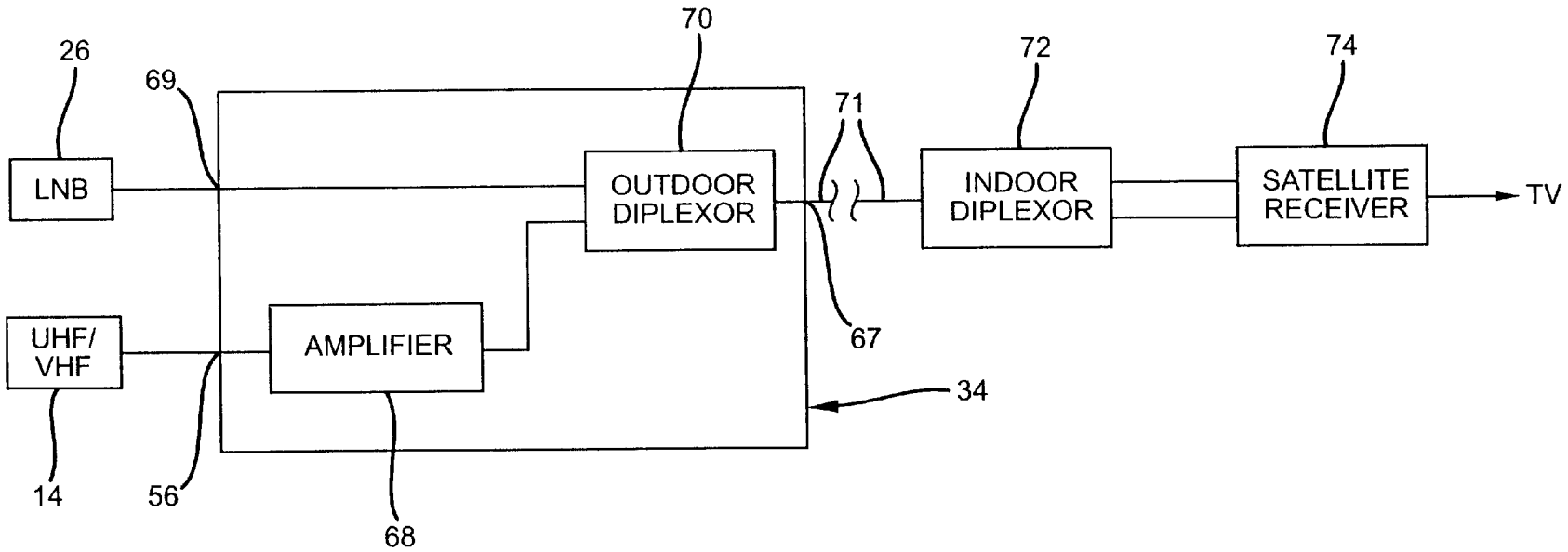
FIGS. 3A and B are respectively a first schematic drawing showing a first embodiment of an amplifying/superimposing circuit for transmitting via a single cable a composite UHF/VHF and satellite signal to a corresponding satellite receiver, and a second embodiment of the satellite signal and superimposing circuit for transmitting respectively via two cables composite UHF/VHF and satellite signals to a pair of corresponding satellite receivers, respectively.

In the first illustrative embodiment of this invention as shown in FIG. 3A, there is included but one sensor 26, which may take the form of a low noise blocker (LNB). The output of the UHF/VHF antenna 14, i.e., that signal appearing across its dipoles 28*a* and *b*, is applied via openings 56 in the housing 34 to the amplifier 68, which amplifies the UHF/VHF video signal and, thereby, improves the fringe reception of these terrestrial signals. The satellite video signals are transmitted from the LNB 26 through the input terminal 69 to one input of an outdoor diplexer 70. The output of the amplifier 68 is applied to the other input of the diplexer 70. As is well known in the art, the diplexer circuitry sums the video signals from the UHF/VHF antenna 14 and the satellite video signal from the LNB 26. The summed signal outputted by the diplexer 70 is connected to the output terminal 67. Only a single coaxial cable 71 is necessary to transmit this summed signal into the interior of the structure on which the antenna assembly 10 is mounted, to be displayed by a TV set. In particular the coaxial cable is connected to an indoor diplexer 72, which as is well known in the art separates the summed signals into satellite and UHF/VHF video signals which appear at its corresponding outputs. Both of these outputs are in turn supplied to a satellite receiver 74, which operates to detect and amplify the satellite signals before applying them to the TV set.

In order to power sensor or LNB 26 and the amplifier 68, the satellite receiver 74 in addition to receiving, demodulating and amplifying functions, also operates as a power source to supply via the diplexers 70 and 72 a DC voltage to each of the amplifier and the LNB 26. The voltage appearing at the amplifier 68 varies illustratively in the range of 13 V to 18 V. In order for the amplifier 68 to amplify the UHF/VHF video signals a controlled amount, it is necessary to regulate the voltage applied to the amplifier 68. In one embodiment of this invention, a voltage regulator is built into the amplifier 68 to provide a regulated 12 V, for example, to energize the amplifier 68 and, thus, amplify these video signals a steady controllable amount. The circuit arrangement shown in FIG. 3A permits a simple and efficient installation of the antenna assembly 10 that requires the running of but a single coaxial cable 71 between the assembly 10 and the indoor diplexer 72. The single cable 71 transmits in a first direction an energizing voltage to the amplifier 68 and the senor 26, while also transmitting in a second opposite direction the UHF/VHF and satellite video signals to the indoor diplexer 72 and the satellite receiver 74.

Figure 3B:
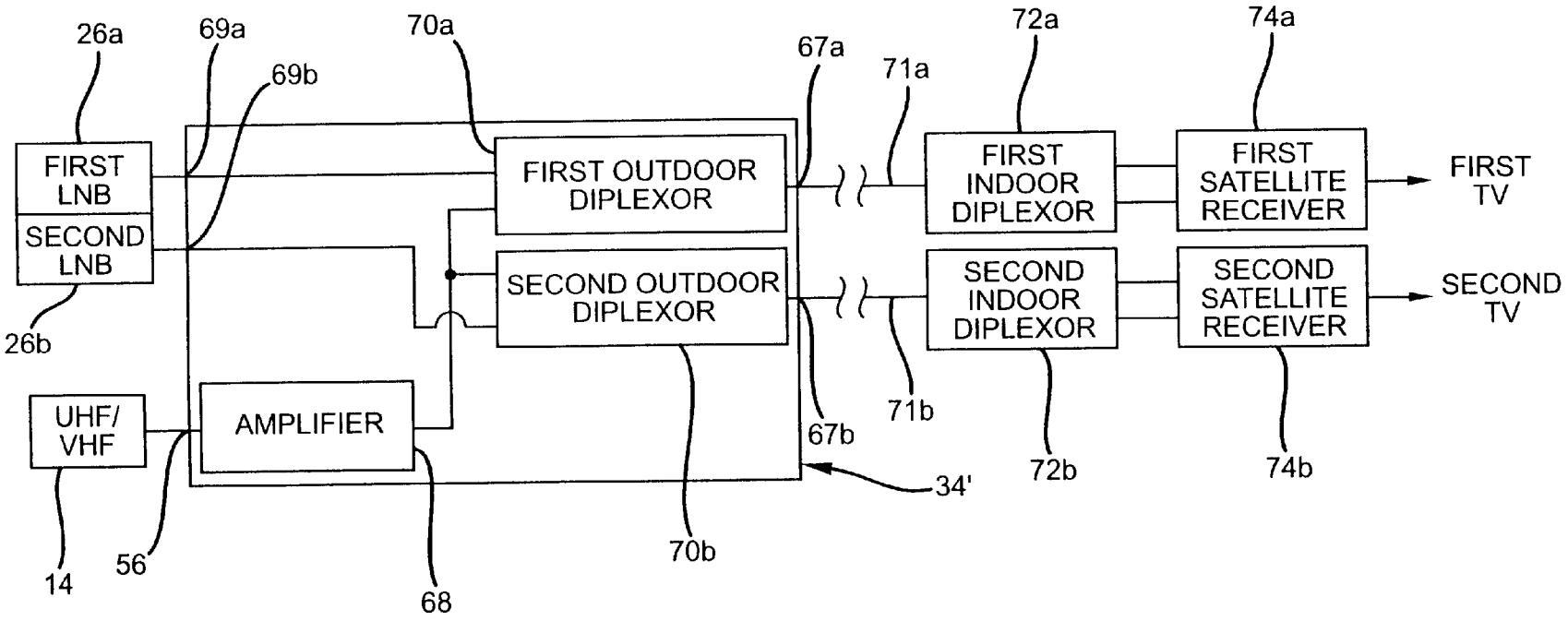

A second illustrative embodiment is shown in FIG. 3B that uses two sensors 26*a* and *b*, a first LNB 26*a* and a second LNB 26*b*, to simultaneously receive and transmit two satellite video signals to be displayed on two TV sets, which are typically disposed at separate locations within the structure or residence. The first and second LNBs 26*a* and *b* apply respectively their satellite video signals via inputs 69*a* and *b* to one input of each of a first outdoor diplexer 70*a* and a second outdoor diplexer 70*b*. The UHF/VHF antenna 14 applies its terrestrial signal via the openings 56 of the housing 34' to the other inputs of the diplexers 70*a* and *b*. Via the amplifier 68. The composite signals outputted by the diplexers 70*a* and *b* are connected respectively by the output terminals 67*a* and *b* to their respective coaxial cables 71*a* and *b*. These cables are run from the antenna assembly 10 as mounted on the residence to the TV set locations, typically separate rooms, within the residence. The coaxial cables 71*a* and *b* are connected to their respective indoor diplexers 72*a* and *b*, which separate their composite signals into the satellite and UHF/VHF components and applies these signals to their respective satellite receivers 74*a* and *b*. This configuration of the circuitry with the housing 34' permits a single antenna assembly 10 to transmit two composite signals to separate TV sets. Only two coaxial cables are needed to interconnect the assembly 10 and the 2 TV sets. Each of these two cables transmits power to their sensors 26*a* and *b*, and transmits composite video signals to separate TV sets, where separate programs may be viewed.

It will thus be seen that the objects set forth above, and those made apparent from the foregoing description, are efficiently attained and, since certain changes may be in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A UHF/VHF antenna subassembly able to be coupled to a pre-existing satellite dish antenna, the satellite dish antenna receiving and outputting at least one satellite video signal, the antenna subassembly comprising:

a) a terrestrial antenna, the terrestrial antenna receiving and outputting a terrestrial video signal;

b) a power amplifier, the power amplifier being responsive to the terrestrial video signal, the power amplifier being able to amplify the terrestrial video signal, the power amplifier outputting an amplified terrestrial video signal; and c) a first diplexer, the first diplexer including a first input a second input and an output, the first input of the first diplexer being able to be coupled to a satellite dish antenna, the satellite dish antenna outputting a first satellite video signal, the satellite dish antenna not being required to receive and output the terrestrial video signal, the first input of the first diplexer being responsive to the first satellite video signal, the second input of the first diplexer being able to be coupled to the power amplifier, the second input of the first diplexer being responsive to the amplified terrestrial video signal, the first diplexer being operative to sum the amplified terrestrial video signal and the first satellite video signal to form a first aggregate signal, the first diplexer outputting the first aggregate signal to the output of the first diplexer in a first direction.

2. The UHF/VHF antenna subassembly as defined by claim 1, wherein the output of the first diplexer is coupled to at least one power signal, the first diplexer being able to output the at least one power signal to the power amplifier at the second input of the first diplexer, the at least one power signal being conducted from the output of the first diplexer to the second input of the first diplexer in a second direction, the second direction being opposite to the first direction, the at least one power signal being able to energize the power amplifier.

3. The UHF/VHF antenna subassembly as defined by claim 1, wherein the satellite dish antenna includes a first receiver and a second receiver, the first receiver of the satellite dish antenna being able to receive and output the first satellite video signal, the second receiver of the satellite dish being able to receive and output a second satellite video signal.

4. The UHF/VHF antenna subassembly as defined by claim 3, further including a second diplexer, the second diplexer including a first input, a second input and an output, the first input of the second diplexer being able to be coupled to the satellite dish antenna, the first input of the second diplexer being responsive to the second satellite video signal, the second input of the second diplexer being able to be coupled to the power amplifier, the second input of the second diplexer being responsive to the amplified terrestrial video signal, the second diplexer being operative to sum the amplified terrestrial video signal and the second satellite video signal to form a second aggregate signal, the second diplexer outputting the second aggregate signal to the output of the second diplexer in the first direction.

5. The UHF/VHF antenna subassembly as defined by claim 4, wherein the output of the second diplexer is coupled to at least one power signal, the second diplexer being able to output the at least one power signal to the power amplifier at the second input of the second diplexer, the at least one power signal being conducted from the output of the second diplexer to the second input of the second diplexer in a second direction, the second direction being opposite to the first direction, the at least one power signal being able to energize the power amplifier.

6. The UHF/VHF antenna subassembly as defined by claim 1, wherein the terrestrial antenna includes at least one dipole antenna, the dipole antenna being able to receive and output the terrestrial video signal.

* * * * *